United States Patent [19]

Hebert

[11] Patent Number: 4,549,682

[45] **Date of Patent: * Oct. 29, 1985**

[54] PORTABLE PNEUMATIC NAIL DRIVING APPARATUS

[75] Inventor: Francis A. Hebert, Schriever, La.

[73] Assignee: Soloco, Inc., Lafayette, La.

[ * ] Notice: The portion of the term of this patent subsequent to Mar. 13, 2001 has been disclaimed.

[21] Appl. No.: 503,551

[22] Filed: Jun. 13, 1983

Related U.S. Application Data

[63] Continuation-in-part of Ser. No. 386,311, Jun. 8, 1982, Pat. No. 4,436,235.

[51] Int. Cl.[4] ..... B25C 1/02

[52] U.S. Cl. ..... 227/119; 227/147; 227/111

[58] Field of Search ..... 227/109, 110, 111, 112, 227/120, 130, 147, 148, 156, 719

[56] References Cited

U.S. PATENT DOCUMENTS

| | | | |
|---|---|---|---|
| 80,477 | 7/1868 | Hale | 227/147 |
| 302,092 | 7/1884 | Bokenkotter | 227/147 |
| 438,865 | 10/1890 | Sheldon | 227/147 |
| 539,065 | 5/1895 | Lombard | 227/147 X |
| 545,298 | 8/1895 | Loetscher | 227/147 X |
| 579,880 | 3/1897 | Langston | 227/147 X |
| 677,155 | 6/1901 | Blankenburg | 227/147 |
| 1,241,996 | 10/1917 | Kristiansen | 227/147 |
| 1,262,486 | 4/1918 | Hansen | 227/147 |
| 1,644,409 | 10/1927 | Winchell | 227/147 |
| 1,716,579 | 6/1929 | Dougherty | 227/111 |
| 1,851,931 | 3/1932 | Chapman | 227/147 X |
| 3,074,069 | 1/1963 | Conrad | 227/147 |
| 3,158,867 | 12/1964 | Moss | 227/147 |
| 3,173,593 | 3/1965 | Elliott | 227/111 |
| 3,796,354 | 3/1974 | Downing | 227/111 |
| 3,891,133 | 6/1975 | Maier et al. | 227/10 |
| 3,952,398 | 4/1976 | Haytayan | 29/432 |
| 3,967,771 | 7/1976 | Smith | 227/10 |
| 3,984,040 | 10/1976 | Fry | 227/7 |
| 4,084,738 | 4/1978 | Schneider | 227/7 |
| 4,085,882 | 4/1978 | Stamper | 227/147 |
| 4,122,904 | 10/1978 | Haytayan | 173/15 |
| 4,215,808 | 8/1980 | Sollberger et al. | 227/146 |
| 4,436,235 | 3/1984 | Hebert | 227/147 X |

*Primary Examiner*—Paul A. Bell

*Attorney, Agent, or Firm*—Wilkinson Mawhinney & Theibault

[57] ABSTRACT

The present disclosure is directed to a nail driving apparatus having a percussive air hammer driving a chisel. The apparatus has a base member, having guide means upstanding from each side of the base member. A cradle means is movable along the guide means and means carried by the cradle means is adapted to mount the air hammer securely to said cradle means. A nail barrel means is carried by the base member into which both nails to be driven and the chisel of the air hammer is positioned on the base member to be received and one of the guide means upstanding from the base member forms a nail chute having means for delivering nails singly to the barrel means beneath the chisel when the air hammer and cradle is raised. A nail chute transfer means is positioned to receive nails from a nail chute in one of the guide means and to direct nails into the nail barrel means through the intermediary of an antijamming chamber between said transfer chute and chisel causing a nail fed from said transfer chute means to be pivoted and hung by its head out of the way of the chisel until the chisel is raised clear of contact with the nail head permitting the nail to drop into the barrel in position to be driven by the chisel.

2 Claims, 9 Drawing Figures

PORTABLE PNEUMATIC NAIL DRIVING APPARATUS

This application is a continuation-in-part of my copending application Ser. No. 386,311, filed June 8, 1982, now U.S. Pat. No. 4,436,235.

TECHNICAL FIELD

My invention is directed to portable pneumatic nail driving devices for working with large nails ranging in size from 30 to 90 penny which are fed from a primary chute through a transfer chute to a nail driving barrel carried by a base frame. Upstanding from the base are guides over which slides a cradle to which a pneumatic gun having a chisel is carried so that the chisel enters the barrel after a nail has been introduced to drive the nail. Such apparatus is used in the construction of board roads in swamps incident to oil field work.

The barrel is provided with an antijam chamber cooperating with the barrel, transfer chute and nail to prevent the chisel from jamming the nail upon descent of the chisel to drive a nail from the barrel.

BACKGROUND ART

Heretofore manual nail driving machines have been known such as the following U.S. Pat. Nos.:

| | | |
|---|---|---|
| E. Hale | 1868 | 80,477 |
| J. S. Bokenkotter | 1884 | 302,092 |
| M. A. Sheldon | 1890 | 438,865 |
| H. Blankenburg | 1901 | 677,155 |
| K. O. Kristiansen | 1917 | 1,241,996 |
| R. Hansen | 1918 | 1,262,486 |
| L. J. Winchell | 1927 | 1,644,409 |
| D. J. Dougherty | 1929 | 1,716,579 |
| R. Stamper | 1978 | 4,085,882 |

Thereafter pneumatic nail machines were developed some of which were mobile as exemplified in the following U.S. Pat. Nos.:

| | | |
|---|---|---|
| R. A. Conrad | 1963 | 3,074,069 |
| L. E. Moss | 1964 | 3,158,867 |
| R. W. Elliott | 1965 | 3,173,593 |
| H. N. Downing | 1974 | 3,796,365 |
| E. Maier et al | 1975 | 3,891,133 |
| H. M. Haytayan | 1976 | 3,952,398 |
| J. E. Smith | 1976 | 3,967,771 |
| A. H. Fry | 1976 | 3,984,040 |
| F. H. Schneider | 1978 | 4,084,738 |
| H. M. Haytayan | 1978 | 4,122,904 |
| R. W. Sollberger et al | 1980 | 4,215,808 |

The foregoing patents are the most relevant art known to me at the time of filing this application.

DISCLOSURE OF THE INVENTION

In accordance with my invention I provide a portable nail driving apparatus which may be pushed around on the job by one man and which is pneumatically driven for driving nails from 30 to 90 penny into multiple layers of boards.

The principal feature of the present invention is the provision of a nail driving apparatus to which a pneumatic gun driving a chisel may be attached to drive nails fed from a chute to a nail driving barrel which nails pass through a transfer chute from a primary chute in one of the guide members to the nail driving barrel which receives the free end of the pneumatically driven chisel upon the nail heads for driving the nails into the boards.

Another feature of the present invention is the provision of a base member having two upstanding guide members one of which forms a primary nail chute and both of which form guides for a cradle which removably carries the pneumatic gun.

A still further feature of the present invention in addition to the above is the primary nail chute in one of the guide members which carry the cradle for the pneumatic gun to position the chisel in the barrel means behind the nails dropped into the barrel through the primary chute and nail transfer chute to properly position the chisel in its nail driving relationship therewith.

A still further improvement in the present invention over the prior art is the provision of a ground transport wheel on the underside of the base member from which the guides and cradle are carried, thus permitting single hand pushing and guiding of the apparatus around the surface of a job employing the above nail driving apparatus.

A further improvement of the present invention over the art is the provision of an antijamming chamber between the nail transfer chute and barrel so that the chisel upon decent cannot jam a nail in the barrel and the nail cannot drop into the barrel until the chisel is retracted to clear the nail and allow it to fall into the barrel beneath the chisel.

THE BEST MODE FOR CARRYING OUT THE INVENTION

Figure 1:
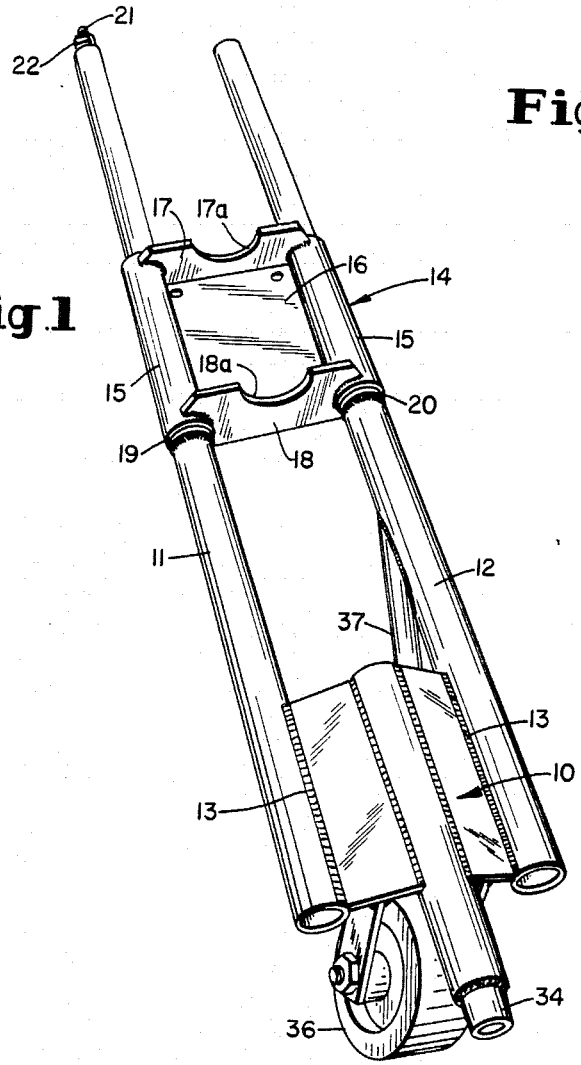
FIG. 1 is a front perspective view of the nail driving apparatus of the present invention with the air hammer gun removed.
Figure 2:
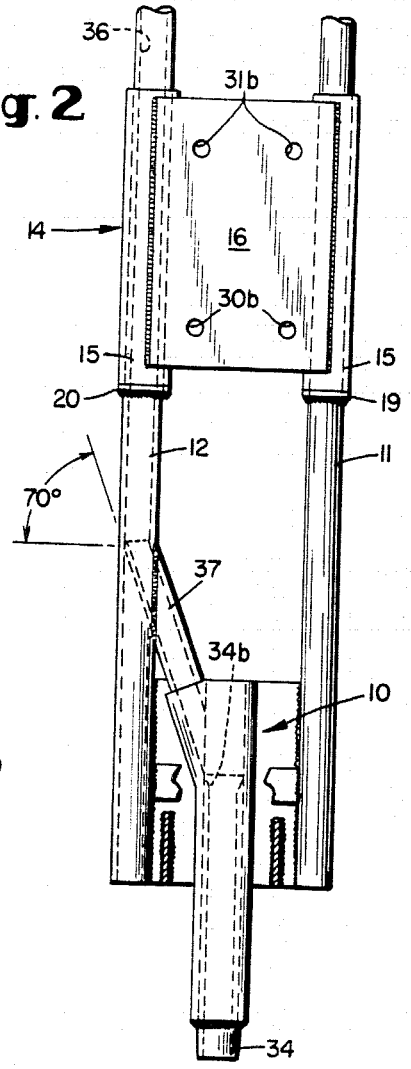
FIG. 2 is a rear elevational view of the apparatus of FIG. 1.
Figure 3:
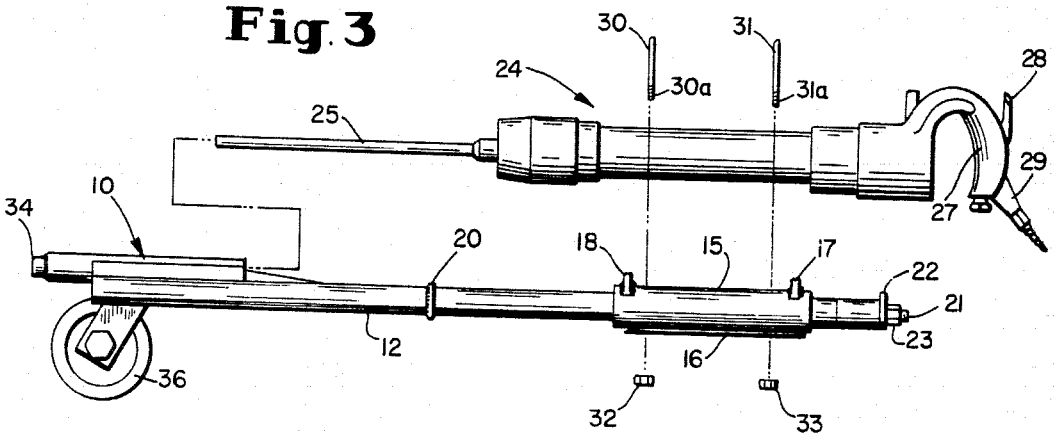
FIG. 3 is an exploded side elevational view of the nail driving apparatus of the present invention with the pneumatic air hammer gun poised above the apparatus for mounting thereon.

Referring now to FIGS. 1 through 3 inclusive, the nail driving apparatus has a base member 10, having two tubular guides 11 and 12 upstanding therefrom and secured thereto as by welds 13. A cradle 14 has tubular members 15 concentric with and slidable along the tubular guides 11 and 12, joined by a base plate 16 to which are welded gun supports 17, 18 having gun cutouts 17*a*, 18*a*. Limit stops 19 and 20 are welded to the tubular guides 11, 12 positioned to be engaged by the tubular members 15 of the cradle to limit downward travel thereof. A threaded shaft 21 secured in the tubular guide 11 has a limit stop 22 and nut 23 to limit upper travel of the cradle to avoid pulling the gun and cradle from the guides 11, 12 when picking the unit up.

As shown in FIG. 3 the percussive air hammer gun 24 has a nail driving chisel 25, air drive mechanism 26, pistol grip 27, trigger 28 and a service air connection 29. The gun 24 is secured in the cutouts 17*a*, 18*a* of the supports 17, 18 on cradle 14 by U-shaped clamps 30, 31 having threaded ends 30*a*, 31*b* to receive nuts 32, 33 which clamps pass through openings 30*b*, 31*b* in plate 16.

Centrally of the base member 10 is the nail barrel means 34 into which both nails 35 to be driven and the chisel 25 of the air gun 24 are received. This barrel 34 has a tapered conical mouth 34*b*.

The tubular guide means 12 is hollow and forms a nail chute means 36 for delivering nails 35 down the guide 12 to a nail chute transfer means 37 to a tube 34*a* which extends above the nail barrel means and which is open to the transfer chute 37 to permit nails 35 to pass from the tube 12 through transfer chute 36 to the barrel 34.

Figure 4:
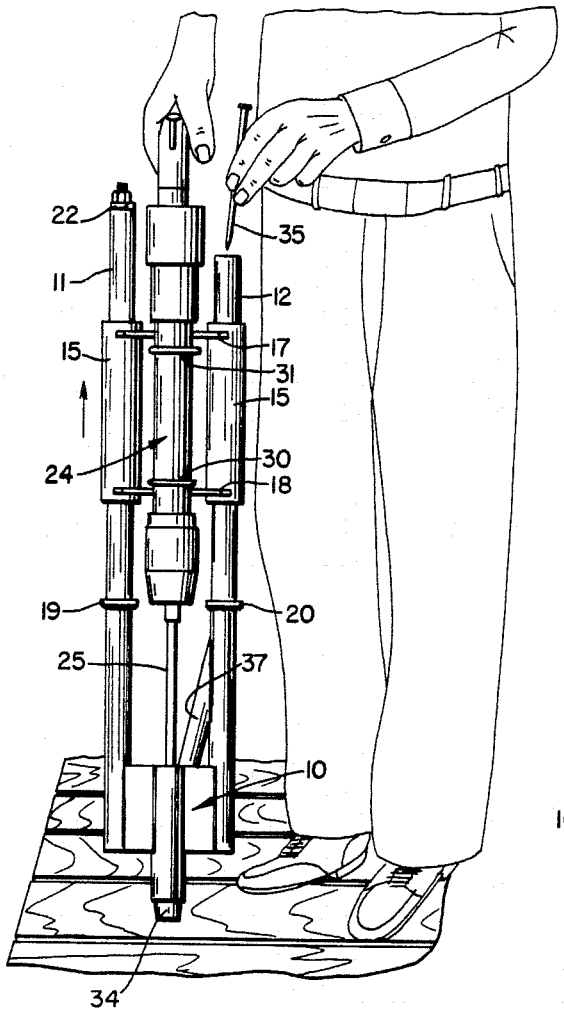
FIG. 4 is a front elevational view of the apparatus of the present invention shown a job site being held by an operator with the air gun and cradle assembly in raised position and inserting a nail into the nail chute prior to lowering the carriage and gun.
Figure 5:
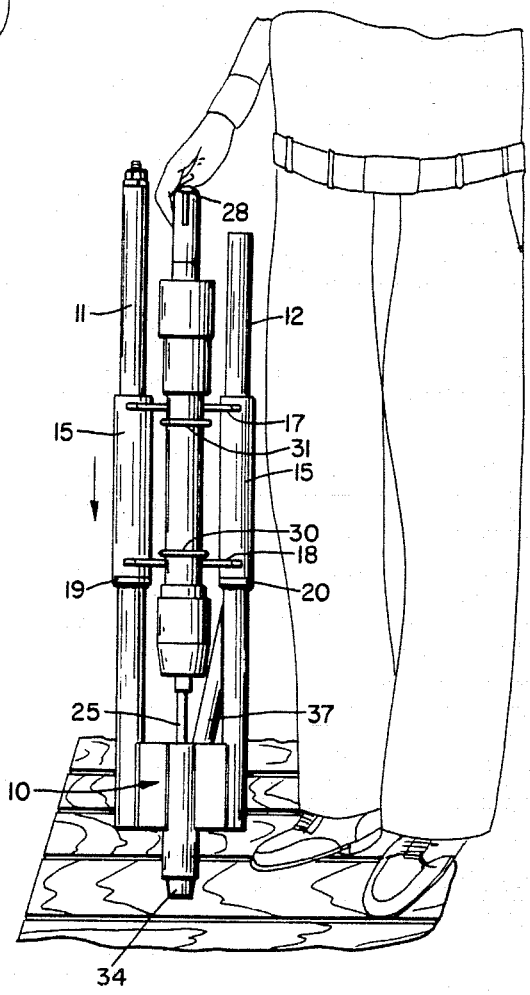
FIG. 5 is a view similar to FIG. 4 with the nail having been dropped in the chute 12 and resting in the barrel and thereafter the carriage cradle is lowered and the chisel of the air hammer bears against the nail in the barrel at which time the operator presses the trigger of the air gun to drive the nail into the boards.

In operation when it is desired to drive a nail by way of example when laying a board road with the boards in position and the air gun attached to the cradle as shown in FIG. 4, the operator grasps the gun 24 by its pistol grip 27, raises the gun and cradle, placing the nuzzle of the barrel 34 against the boards to be nailed, inserts the nail 25 into the tube 12 from which it passes through tube 12, chute 37 to to barrel 34. The gun and cradle are lowered with the chisel 25 against the boards to be nailed, the gun and cradle are lowered with the chisel 25 entering the barrel 34 as shown in FIG. 5. The trigger 28 is then actuated at which time the chisel 25 drives the nail 35 into the boards.

The gun 24 or percussive air hammer may be of the Ingersoll Rand Type 9001 Air Hammer shown on page 95 of the 1981 Catalogue entitled AIR TOOLS SIXTH EDITION, FORM 5107E by Ingersoll Rand Power Tool Division, 27 Kennedy Blvd. East Brunswick, N.J. 08816.

The base member 10 may have a freely rotatable transport wheel 36 is mounted on its rear side, as shown in FIGS. 1 and 3 for moving the unit easily by hand pushing it along the job site.

Referring now to FIGS. 6 through 9, an improved barrel 40 is shown having an attaching plate 41 having bolt openings 42. The barrel 40 has an opening or bore 43 through which the nail driving chisel 25A reciprocates. A nail feed tube 44 extends angularly off the upper portion of the barrel for receiving the nail chute transfer tube 37 at its upper end and has a nail holding slot 45 which cooperates with the nail driving chisel 25A to cause the nail 46 to be hung beneath its head 47 so that the nail body 48 hangs in an antijamming chamber 49 until the chisel 25A is withdrawn permitting the nail 46 to drop into the barrel 40 so that the chisel 25A can be lowered into driving engagement with the head 47 of nail 46.

Figure 8:
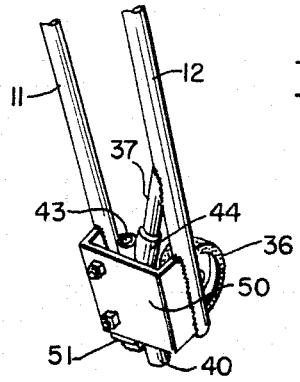
FIG. 8 is a fragmentary top perspective view of the apparatus of the present invention showing the nail barrel and antijamming chamber of FIG. 6 in place thereon.

The barrel attaching plate 41 is bolted to the barrel support 50 which is welded between the two tubular guides 11 and 12 as shown in FIG. 8.

Figure 6:
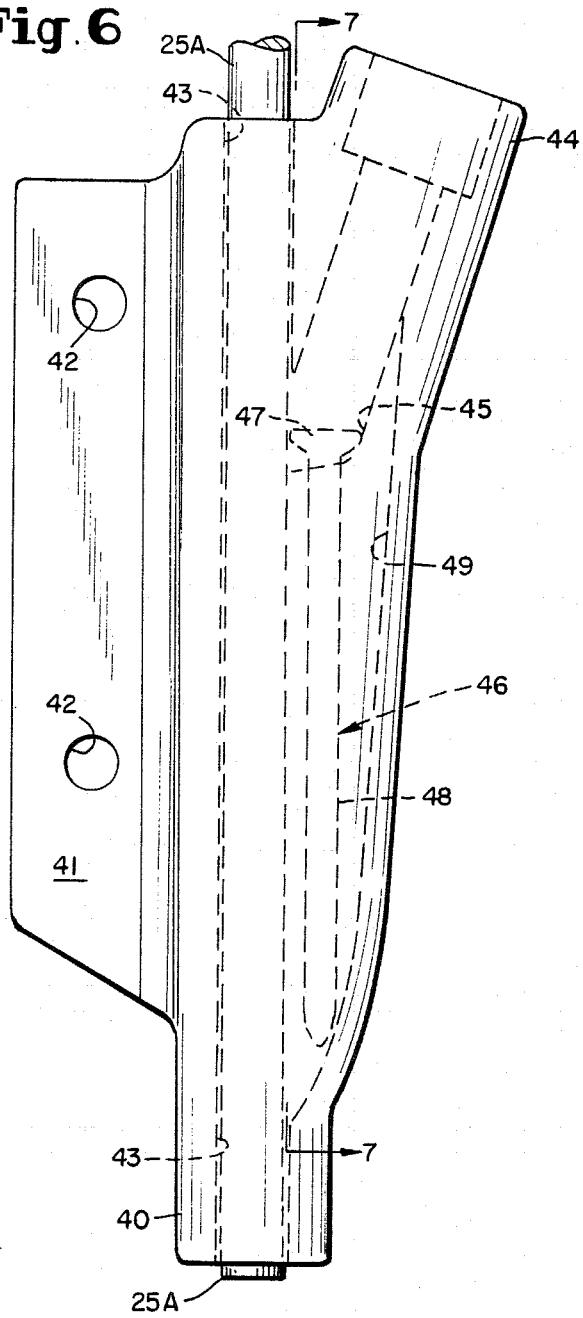
FIG. 6 is a bottom plan view of the nail barrel and antijamming chamber for connection to the transfer chute and base member connected between the two tubular guides.
Figure 7:
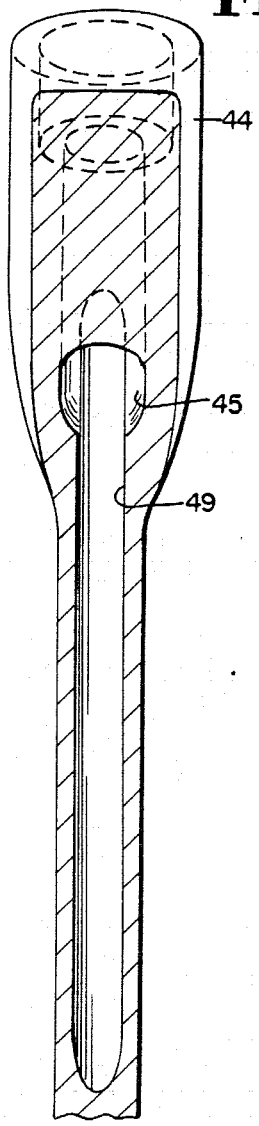
FIG. 7 is a vertical section taken on the line 7—7 in FIG. 6 showing the nail holding slot.
Figure 9:
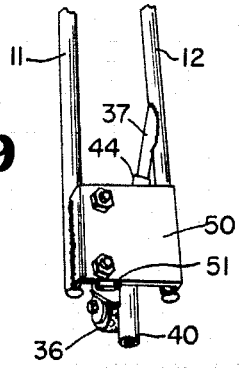
FIG. 9 is a bottom perspective view of the nail barrel and antijamming apparatus of FIG. 6 applied to the nail driving apparatus of the present invention.

A barrel positioning lug 51 carried by attaching plate 41 positions the barrel 40 antijamming chamber 56 of FIG. 6 so that attaching bolts and nuts may secure the barrel 40 to the barrel support 50 as shown in FIG. 9.

What is claimed:

1. In combination, a nail driving apparatus comprising a base member with guides upstanding therefrom and a cradle movable thereover carrying a percussive air hammer attached thereto and having a nail driving chisel extending therefrom and wherein one of said guides forms a nail chute for delivering nails to be driven by said chisel; a nail driving barrel means comprising a nail driving barrel adapted to be positioned on said base member to receive the nail driving chisel, nail transfer chute means positioned to receive nails from said guide, and antijam means between said transfer chute and chisel causing a nail fed from said transfer chute means to be pivoted and hung by its head out of the way of the chisel until the chisel is raised clear of contact with the nail head permitting the nail to drop into the barrel in position to be driven by the chisel.

2. A nail driving barrel means as claimed in claim 1 wherein said antijam means between said transfer chute and chisel is a chamber at least as long as the nail to be driven having a slotted wall positioned to engage the nail beneath its head causing the major axis of the nail body to be swung into the chamber out of binding contact with the nail driving chisel.

* * * * *